US006505457B2

(12) United States Patent
Grass et al.

(10) Patent No.: US 6,505,457 B2
(45) Date of Patent: Jan. 14, 2003

(54) AUTOMATIC FILM INSERTION DEVICE

(75) Inventors: Jeff Grass, Manhattan Beach, CA (US); Victor V. Menayan, Tucson, AZ (US)

(73) Assignee: Axon Corporation, Raleigh, NC (US)

( * ) Notice: Subject to any disclaimer, the term of this patent is extended or adjusted under 35 U.S.C. 154(b) by 0 days.

(21) Appl. No.: 09/974,574

(22) Filed: Oct. 10, 2001

(65) Prior Publication Data

US 2002/0073653 A1 Jun. 20, 2002

Related U.S. Application Data

(60) Provisional application No. 60/256,702, filed on Dec. 18, 2000.

(51) Int. Cl.[7] ..... B65B 63/02

(52) U.S. Cl. ..... 53/435; 53/474; 53/527; 53/237

(58) Field of Search ..... 53/429, 436, 474, 53/527, 237, 238, 240

(56) References Cited

U.S. PATENT DOCUMENTS

| | | | | | |
|---|---|---|---|---|---|
| 2,833,398 | A | * | 5/1958 | Marshall | 206/459.1 |
| 3,066,460 | A | * | 12/1962 | Lakso | 493/480 |
| 3,280,533 | A | | 10/1966 | Hall | 53/119 |
| 3,863,795 | A | | 2/1975 | Mills | 215/201 |
| 4,279,351 | A | | 7/1981 | Vertes | 215/231 |
| 4,460,090 | A | | 7/1984 | Paoletti | 206/540 |
| 4,531,341 | A | * | 7/1985 | Bittner | 493/419 |
| 4,611,457 | A | * | 9/1986 | Bittner | 53/429 |
| 4,805,789 | A | | 2/1989 | Lancesseur et al. | 215/6 |
| 4,890,753 | A | * | 1/1990 | Duryee et al. | 206/232 |
| 5,056,659 | A | | 10/1991 | Howes et al. | 206/217 |
| 5,096,078 | A | | 3/1992 | McQueeny | 215/231 |
| 5,318,183 | A | | 6/1994 | Cohen et al. | 206/538 |
| 5,411,156 | A | | 5/1995 | Reckamp | 215/231 |
| D361,719 | S | | 8/1995 | Walther | D8/456 |
| 5,709,066 | A | * | 1/1998 | Prochaska et al. | 53/117 |
| 5,738,234 | A | | 4/1998 | Harrold | 215/386 |
| 5,775,059 | A | | 7/1998 | Hampton et al. | 53/429 |

* cited by examiner

*Primary Examiner*—Rinaldi I. Rada
*Assistant Examiner*—Hemant M. Desai
(74) *Attorney, Agent, or Firm*—Kaplan & Gilman, LLP

(57) ABSTRACT

An automatic film insertion device automatically unwinds a predetermined amount of plastic tubing from a roll, measures the required length, cuts and automatically inserts the cut piece into the mouth of filled pharmaceutical bottles. In one embodiment, a set of rollers receives a sheet of tubing, which is passed to a mandrel that opens the tubing. A guillotine cuts the tubing, and the tubing is pushed by a plow into a receiving member. The tubing is held inside the receiving member via friction until a plunger pushes the tubing out of the receiving member and into the bottle. The plunger then forces the tubing to buckle and remain in the bottle. In a second embodiment, the receiving member comprises a reciprocating tube attached to a shuttle cylinder. During the film advance portion of the cycle, the tube is positioned under a film feed station adjacent a cutting assembly. The film is fed vertically downward by rollers into the receiving member and cut. The film is then pushed from the tube into the headspace of the container, after which an actuator actuates a rod that forces the buckled film below the underside of the container neck so that it does not bounce out of the mouth of the container.

19 Claims, 8 Drawing Sheets

AUTOMATIC FILM INSERTION DEVICE

PRIORITY

This application claims priority under 35 U.S.C. 119(e) from U.S. Provisional Patent Application No. 60/256,702, titled AUTOMATIC FILM INSERTION DEVICE, filed on Dec. 18, 2000, incorporated herein by reference.

BACKGROUND OF THE INVENTION

1. Field of the Invention

This invention relates to an apparatus and method for inserting filling material, preferably a hydrophobic plastic film, in the headspace area of pharmaceutical bottles so that their contents do not shift excessively during shipment.

2. Description of the Related Art

Historically, pharmaceutical bottles, after being filled with tablets or capsules, are stuffed with a section of cotton that supports the contents of the bottles from loosely shifting around during shipment, which may adversely impact the quality of the tablets and capsules. Although cotton is the main material used for the stuffing process, because cotton is hydrophilic, it tends to absorb moisture and cause the premature degradation of moisture sensitive pharmaceutical products. To solve this problem, many manufacturers of pharmaceutical products manually insert plastic film materials into the bottle in place of the cotton. The plastic material is usually hydrophobic and therefore does not contribute to the increase of moisture content of the bottles. Obviously, because of the relatively high production speeds in most of these operations, manual plastic film insertion is not a commercially viable solution. There is a need in the art for an invention that eliminates the disadvantages of cotton in pharmaceutical bottles while providing a cost effective means to automatically insert a plastic film material into the headspace of bottles.

SUMMARY OF THE INVENTION

A roll of flattened filling material, such as plastic film or tubing material, is placed on an unwind assembly. The unwind assembly device, using a set of rubberized rollers, advances predetermined lengths of filling material into a receiving member. The filling material is passed through a cutter, such as, for example, a guillotine knife, before or after it is placed in the receiving member and is held inside the receiving member via friction against the walls of the receiving member. A dispensing mechanism then forces the filling material out of the receiving member and into the headspace of a container, causing it to "buckle" or "crimp" and remain in the bottle so that the contents of the bottle do not shift excessively during shipment.

OBJECTS OF THE INVENTION

It is an object of the present invention to fill the head space of pharmaceutical and like containers in order to support the contents of the containers from loosely shifting around during shipment which may adversely impact the quality of the tablets, capsules or other contents.

It is a further object of the present invention to fill the head space in pharmaceutical and the like containers with a material that is preferably not hydrophilic, i.e., a material that does not absorb moisture and cause the premature degradation of moisture sensitive pharmaceutical products.

It is another object of the present invention to fill pharmaceutical containers with a material, which is preferably hydrophobic, automatically and quickly in a commercially viable manner.

These and other objects and advantages of the present invention will be apparent from a review of the following specification and accompanying drawings.

BRIEF DESCRIPTION OF THE DRAWINGS

FIG. 1(*b*) is a partial view of the unwind assembly showing the flattened filling material on a spool roll of the unwind assembly.

FIG. 1(*c*) is a partial view of the roller assembly of the film feed station.

FIG. 7(*b*) shows the elevation view of FIG. 7(*a*), with the rod extended and the filling material fully inserted.

DESCRIPTION OF THE PREFERRED EMBODIMENT(S)

The detailed description set forth below in connection with the appended drawings is intended as a description of presently preferred embodiments of the invention and is not intended to represent the only forms in which the present invention may be constructed and/or utilized. The description sets forth the functions and the sequence of steps for constructing and operating the invention in connection with the illustrated embodiments. However, it is to be understood that the same or equivalent functions and sequences may be accomplished by different embodiments that are also intended to be encompassed within the spirit and scope of the invention.

The preferred embodiment of the invention automatically unwinds a predetermined amount of a filling material, such as for example, a plastic film, from a roll, cuts and automatically inserts the cut piece into the mouth of a filled pharmaceutical container.

Figure 1A:
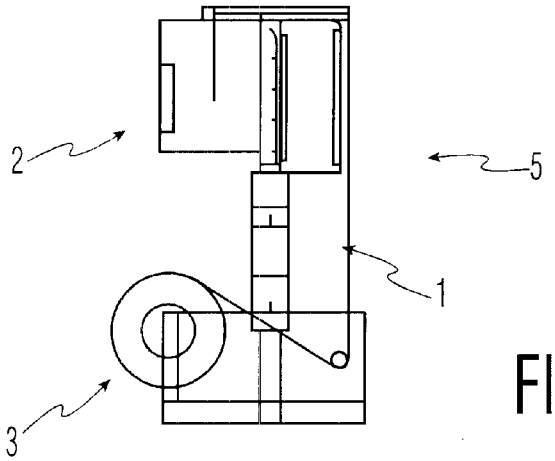
FIG. 1(*a*) shows a side view of an embodiment of the unwind assembly of the present invention.
Figure 1B:
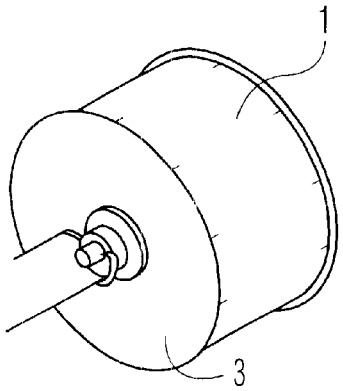
Figure 1C:
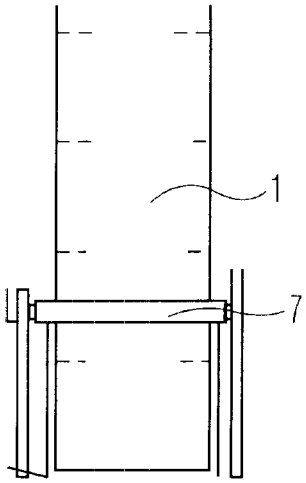

Referring to FIGS. 1(*a*)–1(*c*), a roll 3 of filling material 1 is placed onto an unwind assembly 5. The filling material 1 is preferably a plastic film or plastic tubing material because it is convenient for pharmaceutical bottlers to use, as it is the same material that is used to seal the containers after they are filled. Various materials, however, may be used, such as for example, hydrophobic materials that are resilient yet have sufficient rigidity to "crimp" or "buckle" under pressure. Generally, the filling material will be wound around a roll in a flattened state for storage (FIG. 1(*b*)). An unwind assembly 5, which preferably comprises a set of rubberized rollers 7, advances predetermined lengths of the flattened filling material 1 at a film feed station 2 as it is unwound from a roll (FIG. 1(*b*)). Any suitable type of advancing mechanism, however, may be used.

Figure 2:
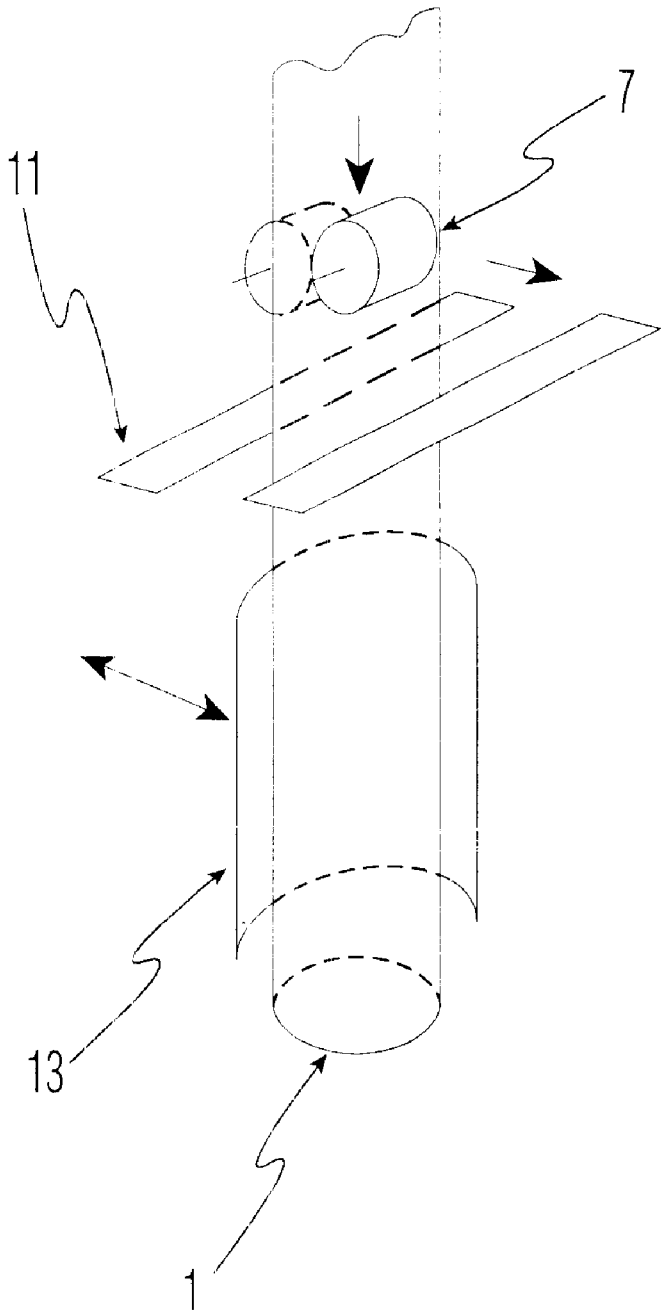
FIG. 2 shows a perspective front view of a plunger-type dispensing mechanism and a clamshell cylinder receiving member.
Figure 3:
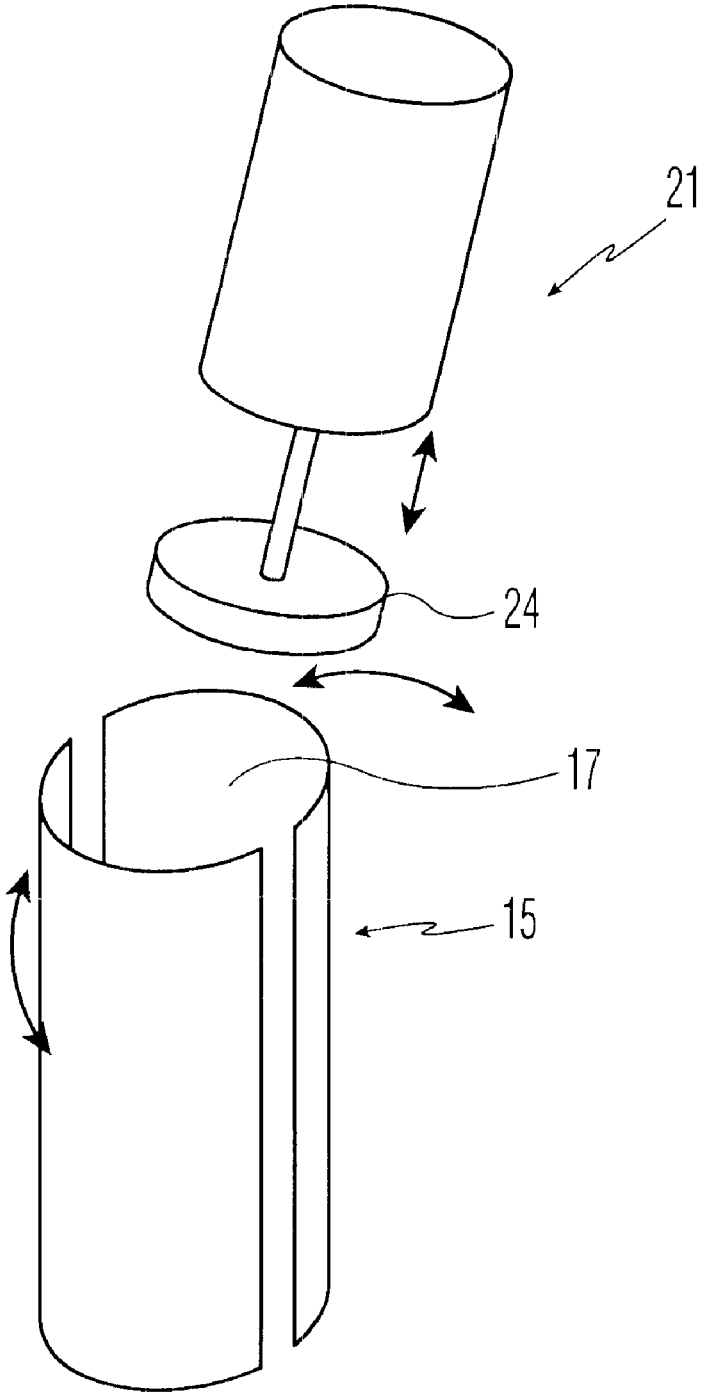
FIG. 3 shows a perspective front view of the roller assembly, plow and a guillotine knife cutting assembly.

In the preferred embodiment, the film is placed into a receiving member 15, shown in FIG. 3, comprising a reciprocating tube attached to a shuttle cylinder. The receiving member 15 is preferably oriented in a vertical position and comprised of a metal, such as aluminum. The receiving member 15, however, may comprise other suitable materials such a plastic resins. Preferably, during the film advance portion of the cycle, the receiving member 15 is positioned under the film feed station 2, which in turn is positioned directly adjacent a cutting assembly. The filling material 1 is preferably fed vertically downward by rubberized rollers 7 at the film feed station 2 into the receiving member 15, and is cut to the appropriate length. The cutting assembly 11 may comprise a guillotine knife, or other suitable means, for cutting the filling material 1 (FIG. 2). Alternately, the cutting assembly may comprise a means for exerting opposite forces on the supply and the predetermined length of plastic film or plastic tubing material, such as in the case where the film or tubing is perforated at regular intervals and can be separated from the supply without cutting.

Once the length of filling material 1 is advanced, placed into the receiving member 15 and cut, friction between it and the inner walls 17 of the receiving member 15 keeps it held within the receiving member 15. For example, in a second embodiment, the filing material 1 may be comprised of a material that causes it to pop open into a three-dimensional open sleeve once it is cut (FIG. 2). The filling material 1 may also be opened from its flattened state prior to cutting, such as for example, by passing it over a support member that cross folds the filing material 1, or by supporting it on a mandrel, causing it to take on a three-dimensional form. The manner in which the flattened filling material 1 is opened, however, is not critical to the invention.

In the second embodiment, a plow 13 (FIG. 2), or other suitable transport device preferably pushes or places the opened filling material 1 into the receiving member 15. For example, the filling material 1 may be pushed by the plow 13 into the receiving member 15 as it is cut and opens into a three-dimensional form. In this embodiment, the receiving member 15 preferably has a cylindrical shape and comprises two halves that move together and apart to open and close the receiving member 15 (FIG. 3). For example, the receiving member 15 may be a mechanically activated clamshell chute. When the halves are pushed together to close the receiving member, the opened filling material 1 is maintained therein via friction between the inside walls 17 of the receiving member 15 and the opened filing material 1. Alternately, the device may be configured such that the opened filing material 1 drops into the receiving member 15 via gravity, or is otherwise transported to the receiving member 15.

Figure 4:
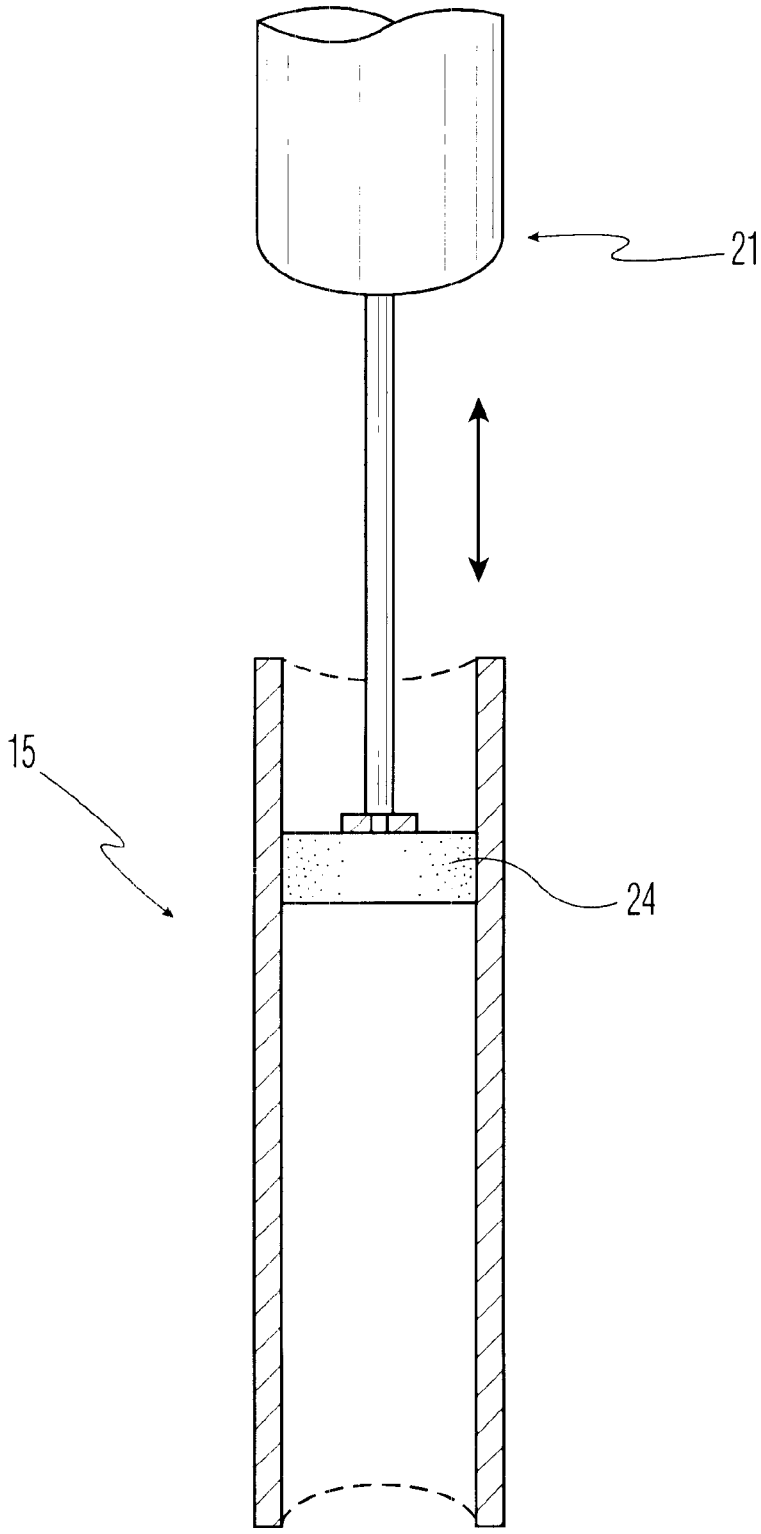
FIG. 4 shows a cross sectional view of a tubular receiving member with the plunger portion of the dispensing mechanism disposed in the receiving member.
Figure 5:
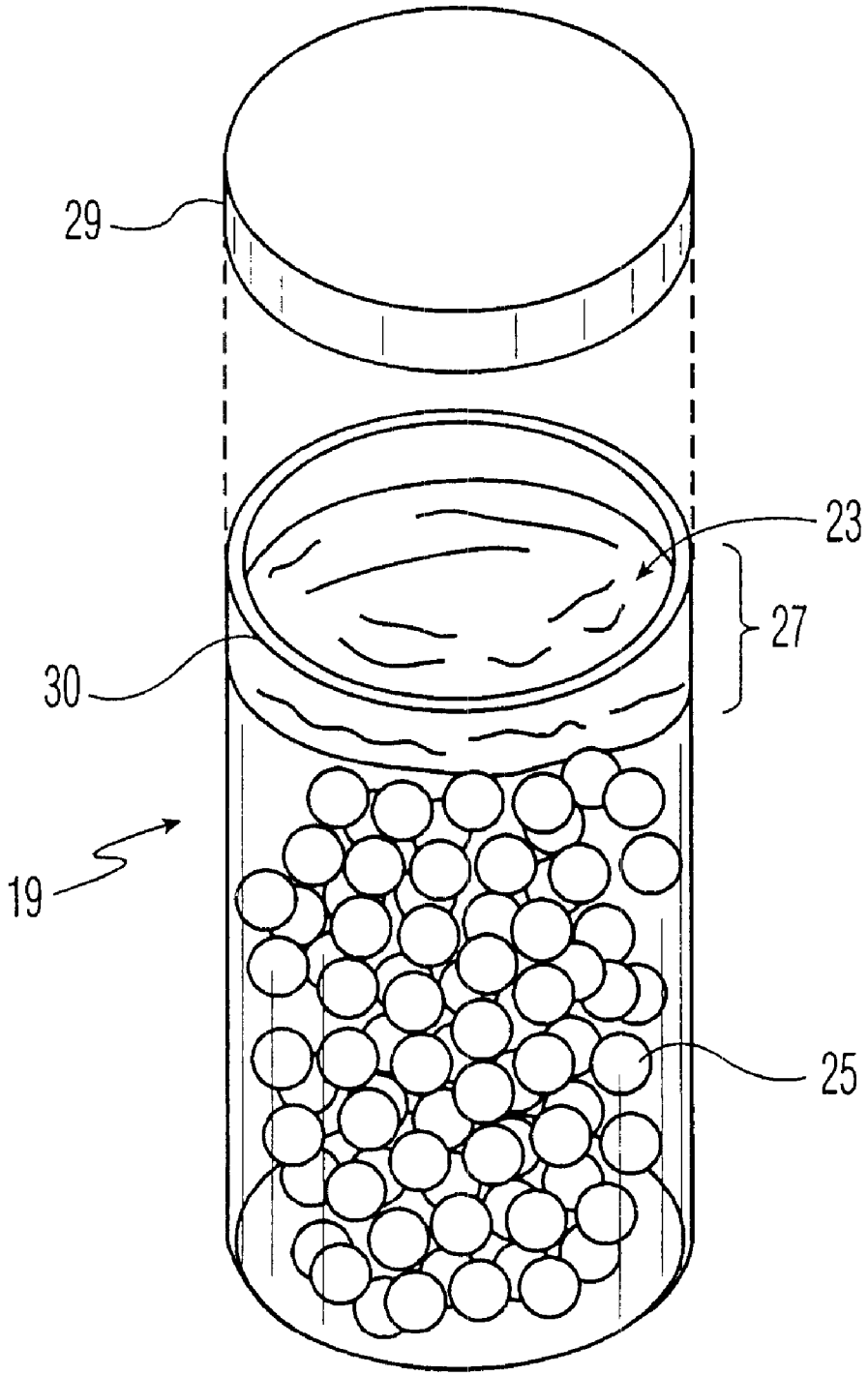
FIG. 5 shows a front view of a container having a ridge along the inner side of the container after the filling material has been inserted into the headspace of the container and positioned to abut against the ridge.
Figure 6:
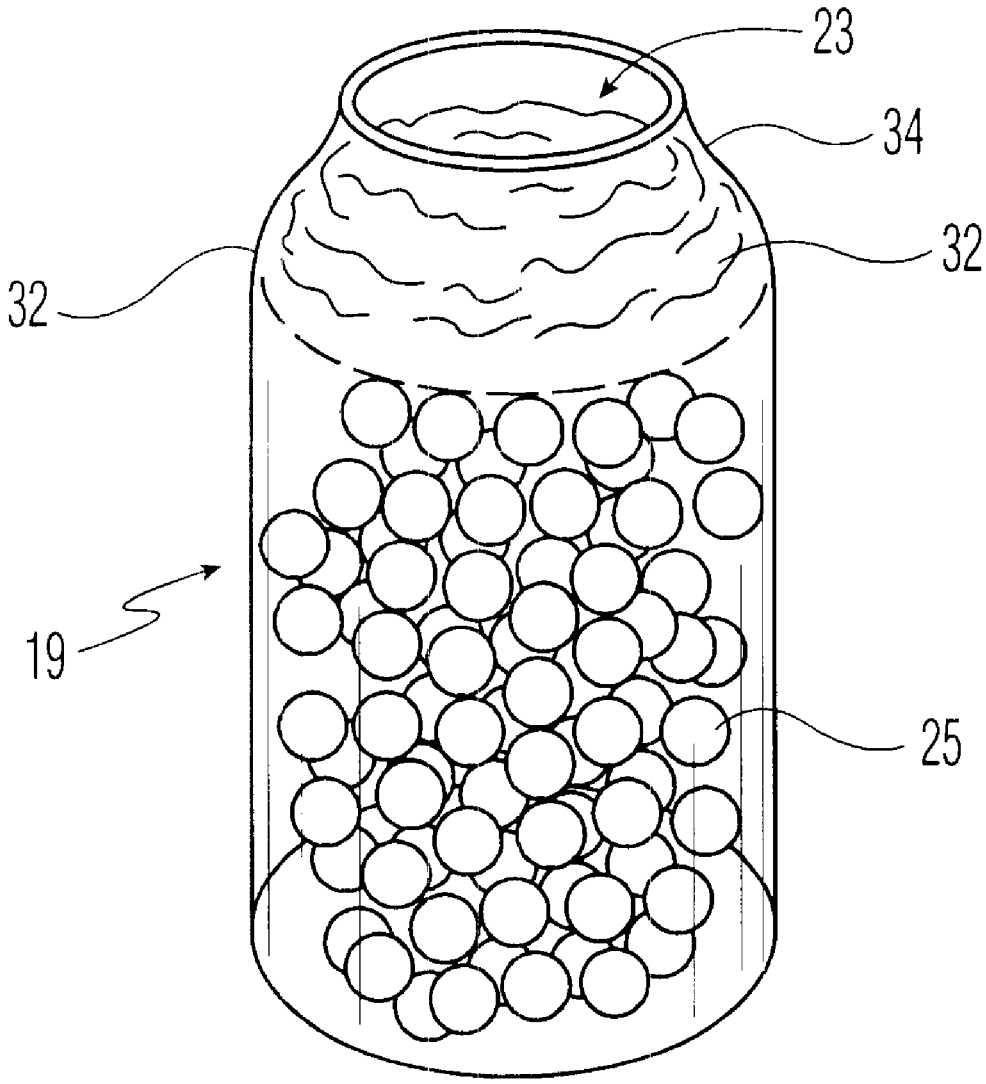
FIG. 6 shows a front view of a container having a neck after the filling material has been inserted into the headspace of the container and positioned to abut against the underside of the container neck.

Next referring to FIG. 5, the receiving member 15 and filling material 1 are shuttled into position under a dispensing mechanism 21, which may be disposed downstream of the cutting assembly 11. The dispensing mechanism 21 preferably comprises an insertion member 24 or other suitable means for pushing the filling material 1 out of the receiving member 15 into the headspace 27 of the container 19. For example, in the preferred embodiment, the dispensing mechanism 21 comprises a plunger that is inserted into the receiving member 15, and which forces the filling material 1 to be pushed down through the receiving member 15 into the waiting container 19 (FIGS. 3–4). The dispensing mechanism 21, however, may comprise other suitable means for forcing the filling material out of the receiving member 15, such as for example, pneumatic devices. The dispensing mechanism 21 may be mounted vertically above an application station where the filling material 1 will be inserted into the container 19. A container 19 having contents 25 is then advanced and positioned under the receiving member 15 at an application station, unless it has been already placed under the receiving member 15. Once the container 19 is properly positioned at the application station, the insertion member 24 of the dispensing mechanism 21 moves downward as shown in FIG. 4. As the insertion member 24 of the dispensing mechanism 21 moves into the receiving member 15, it forces the filing material 1 out of the bottom of the receiving member 15 and into the mouth of the container 19. Once the filling material 1 is inserted into the container 19, the insertion member 24 may travel further into the mouth 23 of the container 19 to force the filling material 1 to buckle and stay in the headspace area 27 of the container 19. The headspace area 27 of the container 19 is the area between the top of the container 19 and the contents 25 of the container 19.

Figure 7A:
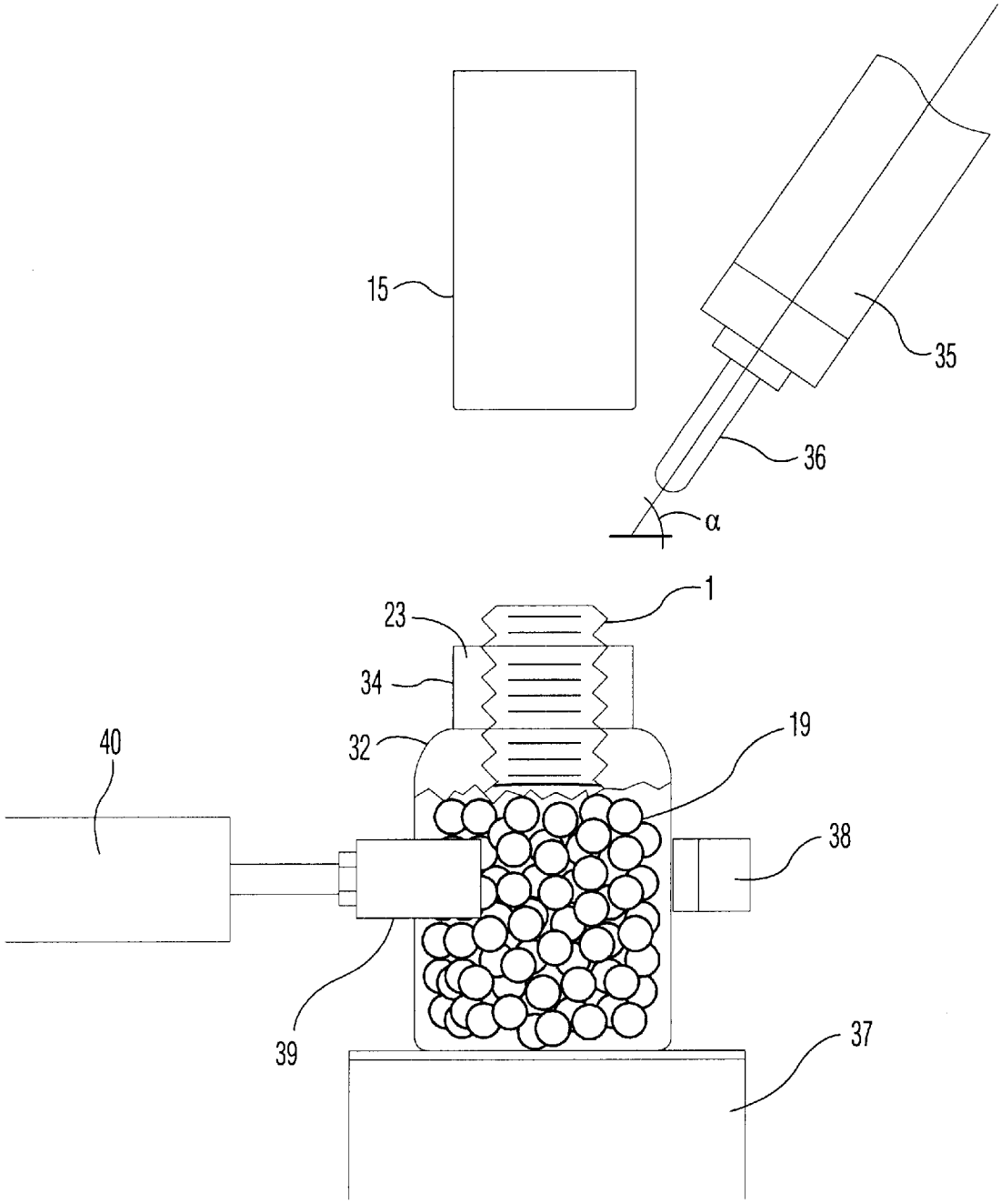
FIG. 7(*a*) shows an elevation view of a container into which filling material has been partly inserted and an angularly mounted rod in recessed position.
Figure 7B:
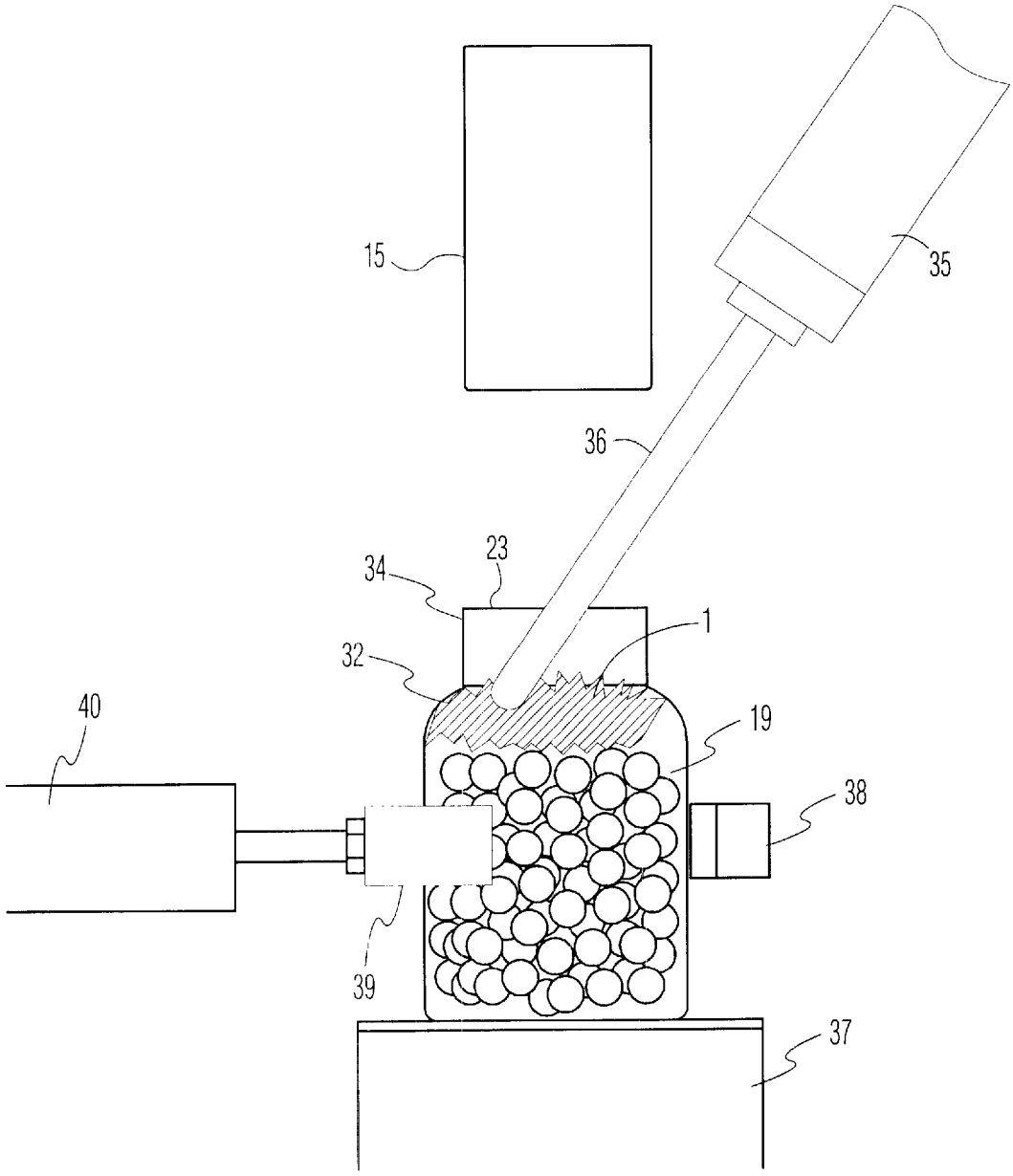

Referring now to FIGS. 7(*a*) and 7(*b*), as filled container 19 is moved by conveyor 27 into a filling station and positioned beneath receiving member 15, a clamp 39 is extended by an activator 40 into contact with a guide rail 38. In the preferred embodiment, an actuator 35 located adjacent the receiving member 15, and preferably mounted at a slight tilt a, actuates an elongated member, such as a rod 36 or other suitable element, into the mouth 23 of the container 19 to push the now buckled filling material into an irregular or angled portion of the container that is continuous with the container, such as the underside 32 of the container neck 34. Alternately, the container 19 may comprise an irregular portion that is not continuous with the container, such as a ridge 30 (FIG. 5) or ledge along the inner surface of the container's mouth 23, neck 34 or sides. The elongated member 36 then pushes the filling material 1 to a position beneath the ridge 30 (or other irregular portion) such that, when the elongated member 36 retracts, the ridge 30 maintains pressure on the filling material 1 and prevents it from bouncing past the ridge 30. This causes the filling material 1 to lock into a position below the mouth 23 of the container 19 and prevents it from bouncing back out of the container 19. The actuator 35 may be activated by any suitable means, such as by hydraulic, pneumatic or mechanical means. The dispensing mechanism 21 (FIG. 4) and the elongated member 36 then retract. Actuator 40 causes clamp 39 to retreat and the container 19 moves downstream of the application station on conveyor 37.

Alternately, the filling material 1 may be pushed into the container such that it buckles and extends partially above the mouth 23 of the container 19. In this embodiment, a cap 29 may provide additional resistance against the contents 25 of the container 19 to decrease their mobility when the cap is placed on the container 19. Once the filling material 1 has been inserted into the container 19, the dispensing mechanism 21 retracts, releasing the container 19 to travel downstream of the application station, and the device is ready for its next cycle.

While the present invention has been described with regards to particular embodiments, it is recognized that additional variations of the present invention may be devised without departing from the inventive concept.

What is claimed is:

1. An automatic film insertion device comprising:

(a) a set of rollers configured to receive flattened hydrophobic tubing material from a supply of tubing material and to advance a predetermined length of the tubing material;

(b) a mandrel being configured and positioned so that it opens the predetermined length of tubing material after it passes through the set of rollers, thereby causing the tubing material to form an open tube;

(c) a cutting assembly that separates the open tube from the supply of tubing material;

(d) a receiving member having an activated position and a closed position and having inner and outer walls, the receiving member being configured such that, in the activated position, it opens to receive the open tube, and when in the closed position maintains the open tube against its inner walls;

(e) a plow configured such that it pushes the open tube into the receiving member when the receiving member is in the activated position; and (f) a plunger configured to be inserted into the receiving member, so that when the plunger is inserted into the receiving member it forces the opened tube down through the receiving member into a container so that the open tube buckles and remains in the container.

2. A method for automatically inserting filling material into a container having contents comprising:

(a) providing supply of filling material, wherein the filling material has an inner surface and an outer surface;

(b) advancing a predetermined length of the filling material;

(c) opening the predetermined length of the filling material to form an open tube;

(d) separating the open tube from the supply;

(e) placing the open tube of filling material into a receiving member having an inner surface and an outer surface, the receiving member being configured so that the open tube will contact the inner surface of the receiving member and be held in the receiving member via friction;

(f) positioning a container underneath the receiving member; and (g) inserting a plunger into the receiving member so that the plunger pushes the filling material into the container.

3. The method of claim 2 wherein the filling material comprises a plastic tubing material.

4. The method of claim 2 wherein the receiving member comprises a cylinder including a first portion and a second portion that move together and apart in relation to each other to open and close the cylinder.

5. The method of claim 4 comprising the step of placing the filling material into the receiving member when the first and second portions are apart, and then pushing the first and second portions together to frictionally hold the filling material in the receiving member.

6. A device for automatically inserting filling material into a container having contents comprising:

(a) a supply of filling material disposed on an unwind assembly, the filling material being substantially hydrophobic;

(b) a separating means for separating a predetermined length of filling material from the supply of filling material, the separating means being disposed downstream of the unwind assembly;

(c) a container with contents having a headspace area and a mouth;

(d) a receiving member having an inner surface and an outer surface, the receiving member being configured to hold the predetermined length of filling material against its inner surface via friction;

(e) an insertion member disposed downstream of the separating means and configured to push the predetermined length of filling material out of the receiving member and into the mouth of the container and force the predetermined length of filling material to buckle in the head space area of the container;

(f) an actuator disposed adjacent the receiving member and configured to actuate an elongated member into the container to force the predetermined length of filling material to lock into a position disposed below the mouth of the container, thereby preventing the filling material from bouncing back out of the container.

7. The device of claim 6 wherein the filling material comprises a resilient material that buckles as it is pushed into the head space of the container.

8. The device of claim 6 wherein the elongated element is a rod.

9. The device of claim 8 wherein the actuator actuates the rod into the container to force the filling material beneath a ridge disposed between the contents and the mouth of the container.

10. The device of claim 8 wherein the container comprises a neck and wherein the actuator actuates the rod into the container to force the filling material beneath the neck of the container.

11. The device of claim 8 wherein the actuator causes the rod to be disposed at a slight angle in relation to the mouth of the container.

12. The device of claim 6 wherein the receiving member comprises a reciprocating tube attached to a shuttle cylinder.

13. A method for automatically inserting filling material into a container having a mouth, headspace and contents to prevent the contents from shifting excessively or being damaged during shipment comprising:

(a) advancing a predetermined length of a substantially hydrophobic filling material from a supply disposed on an unwind assembly;

(b) separating the predetermined length of filling material from the supply;

(c) transferring the predetermined length of filling material to a receiving member, the receiving member having an inner surface and an outer surface, and being configured to hold the predetermined length of filling material against its inner surface via friction;

(d) pushing the predetermined length of filling material out of the receiving member and into the container with a force sufficient to cause the predetermined length of filling material to buckle in the headspace of the container;

(e) actuating an elongated member disposed adjacent the receiving member such that the elongated member enters the mouth of the container at a slight angle;

(f) pushing the filling material with the elongated member so that the filling material is forced past an irregular portion of the container;

(g) retracting the elongated member wherein the filling material expands against and abuts the irregular portion of the container;

whereby the filling material is locked at a position between the contents and the mouth of the container thereby preventing the filling material from bouncing back out of the container.

14. The method of claim 13 wherein the substantially hydrophobic filling material comprises a plastic film.

15. The method of claim 13 wherein the predetermined length of filling material is separated from the supply by cutting.

16. The method of claim 13 wherein the receiving member comprises a cylinder.

17. The method of claim 13 wherein the predetermined length of filling material is pushed out of the receiving member by a plunger.

18. The method of claim 13 wherein the elongated member comprises a rod.

19. The method of claim 13 wherein the irregular portion of the container comprises a ridge.

* * * * *